United States Patent [19]

Delu

[11] 3,969,971

[45] July 20, 1976

[54] INSTRUMENT SYSTEM AND STRINGED-INSTRUMENTS THEREFOR

[75] Inventor: Ion Delu, Bucharest-Mogosoaia, Romania

[73] Assignee: Complexul Pentru Prelucrarea Lemnului Reghin, Bucharest, Romania

[22] Filed: Feb. 18, 1972

[21] Appl. No.: 227,531

Related U.S. Application Data

[63] Continuation-in-part of Ser. No. 70,130, Sept. 8, 1970, Pat. No. 3,691,891, and a continuation-in-part of Ser. No. 83,466, Oct. 23, 1970, Pat. No. 3,680,424.

[52] U.S. Cl. ..... 84/274; 84/291

[51] Int. Cl.[2] ..... G10D 1/02

[58] Field of Search ..... 84/274, 275, 291

[56] References Cited

UNITED STATES PATENTS

| | | | |
|---|---|---|---|
| 572,906 | 12/1896 | McNichol | 84/275 |
| 1,773,133 | 8/1930 | Faccaro | 84/275 |
| 2,150,736 | 3/1936 | Braman | 84/275 |
| 3,136,196 | 6/1964 | Charlesworth | 84/275 |

FOREIGN PATENTS OR APPLICATIONS

| | | | |
|---|---|---|---|
| 12,317 | 3/1881 | Germany | 84/275 |
| 310,314 | 1/1919 | Germany | 84/275 |
| 16,213 | 8/1899 | United Kingdom | 84/274 |

OTHER PUBLICATIONS

Grove's Dictionary of Music & Musicans, edited by H. C. Colles, MacMillan Co., N.Y., 1947, vol. 5, pp. 520–524 & Plate LXXXVIII.

*Primary Examiner*—John Gonzales
*Attorney, Agent, or Firm*—Karl F. Ross; Herbert Dubno

[57] ABSTRACT

Up to twenty bow-operable violin-type stringed instruments, or VIODES of different tonality and twelfth coloration or shade, are combined to form a string ensemble. All of the instruments have substantially identical overall length, fingerboard length, effective string length, and fingering but graduated body sizes (volume, width, thickness). Thus all of the instruments may be played da braccio in exactly the same manner. The higher-pitched groups, the VIODINAS and VIODENAS, are tuned in a relationship similar to that of the customary first and second violin. The next lower group the VIODAS, is tuned one fifth lower, whereas the next lower group, VIOBASA, is an octave lower. The lowest frequency group, VIOGRAVAS, is tuned a twelth lower than the VIODINAS and VIODENAS. The lower three groups are transposing instruments all scored on a g-clef. One instrument for each group can be used to form a balanced quintet, or the VIOGRAVA may be eliminated for a quartet. Each instrument has its sounding boards formed with special resonance zones in the form of concavities or lands having centers inward of the periphery.

5 Claims, 7 Drawing Figures

Viodina A
Vioda B
Viograva D
FIG. I

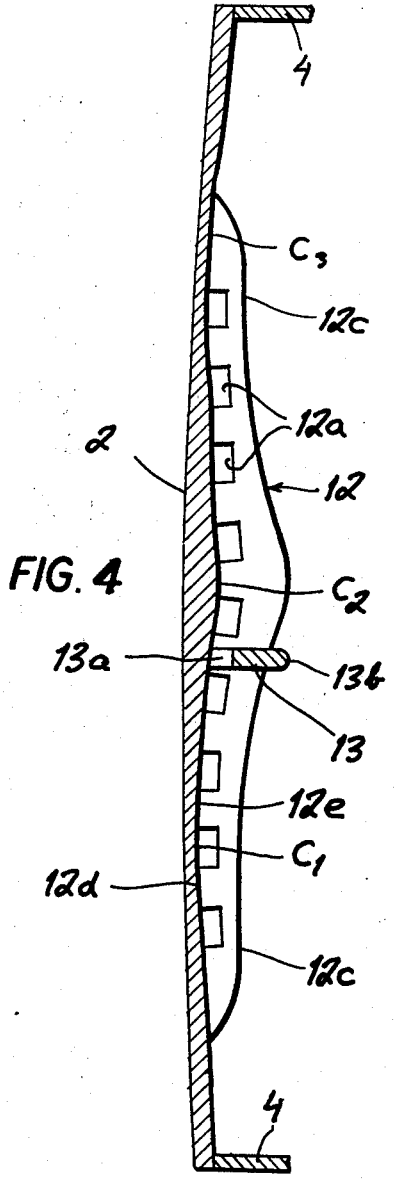
FIG. 4
FIG. 5
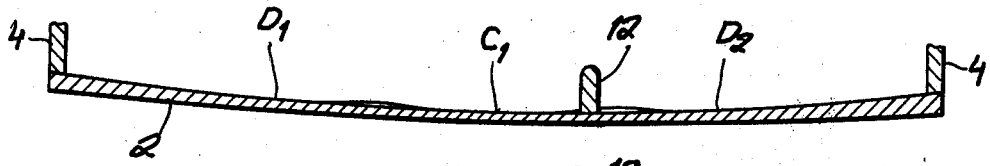
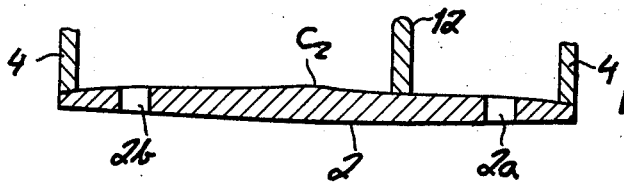
FIG. 6
FIG. 7
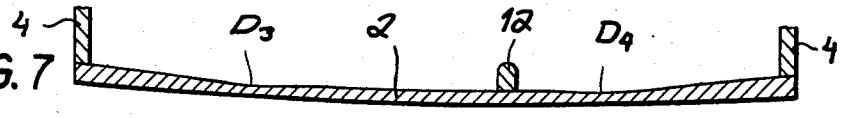

INSTRUMENT SYSTEM AND STRINGED-INSTRUMENTS THEREFOR

1. Cross Reference to Related Applications

This application is a continuation in part of my copending application Ser. No. 70,130 filed Sept. 8, 1970 (now U.S. Pat. No. 3,691,891) and a continuation in part of my copending application Ser. No. 83,466 filed Oct. 23, 1970 (now U.S. Pat. No. 3,680,424).

2. Field of the Invention

The present invention relates to a musical-instrument system and to an instrument for use in such a system. More particularly, this invention relates to functionally and structurally similar bow-operable stringed instruments used in groups to form a musical ensemble.

3. Background of the Invention

Conventional bow-operable stringed instruments of the viol family include the violin (used to play soprano and alto roles as the first and second violin of an ensemble), the viola, the violoncello or simply cello, and the contrabass or bass viol. Viola altas, viola da gambas and the like are also employed at times. Each of the above-named instruments must be played by a specialist who is particularly trained to play his instrument alone. The mastery of any of these instruments is extremely difficult and a time-consuming task that makes it difficult for a musician to master more than one such instrument. Each different instrument requires, in addition, an instructor with the requisite specialized training. Thus the richness in color and nuance obtained by a combination of these instruments as a quartet, quintet, or string orchestra is only to be obtained at great hardship, making it difficult for, say, a medium-sized secondary school ever to be able to form such a string ensemble.

Once the requisite handling of the instruments, training, and talent has been mustered it is necessary to provide scores which are keyed to each separate instrument. Some of the instruments use the g-clef, some the c-clef, and some the f-clef. This problem alone makes it very difficult for one performer to alternate between bow-operated instruments because he must be able not only to read this other notation but must be able to translate it into an appropriate fingering which differs from that to which he may have become accustomed.

Another difficulty with the classic viol family is that certain instruments tend to dominate inherently. Acoustic balancing of such a quartet, quintet, or orchestra is perhaps the greatest difficulty encountered by such an ensemble. The instruments can be made to blend sufficiently only when highly skilled instrumentalists are employed.

This classic viol family has three differently sized instruments. In addition three different methods of fingering are used along with three different musical notations. Some of the instruments are played da braccio, held in the arms, and some are supported on the floor between or against the knees or legs of the instrumentalist.

An attempt to create a new type of string ensemble, the so-called "family of fiddles", was made at Cornell University, New York. This musical system presented certain new colors and ideas. It employed eight different instruments having three different methods of support, some of them totally new. Each instrument had its own unique fingering, scoring and manipulation technique.

In my above-cited copending aplication Ser. No. 83,466 I describe a stringed instrument which avoids these drawbacks in part and which comprises a resonance case formed by a front sound board provided with two f-shaped sound holes, a rear sound board, and a frame glued between the boards. A string-holder is attached to tne case with four strings stretched over a bridge and extending along the neck of the instrument provided with a fingerboard itself extending over the front sound board and with four pegs for anchoring and tuning the strings. A pin pressed between the boards maintains the outwardly bowed or bellied configuration. Each sound board is provided as well with concentric contoured surfaces or endless grooves centered on the board's longitudinal axis and also with roughened surfaces or endless grooves disposed around certain acoustic points situated on the board. Two resonance bars are glued together on the inside part of the front sounding board and are provided on the glued side with grooves or notches where no gluing occurs. One of the bars is disposed parallel to the transverse symmetry axis of the front board (through the centers of the f-openings) and the other is oblique to the longitudinal axis of the board.

Each roughened area or endless groove is paired with another such formation and is more or less blended into the other formations to provide resonance zones on the sounding boards.

My above-cited copending patent application Ser. No. 70,130 describes a similar musical instrument wherein the fingerboard is mounted upon the resonance body and is formed at its end with a scroll accommodating four adjusting pegs, to each of which a string is affixed, the strings running from a string-holder at the opposite end of the resonance body and passing over the usual bridge. The front and rear resonance plates are held apart by a resonance pin. The inner faces of the front and rear resonance plates are as before formed with recesses centered along the longitudinal axis of the instrument and with additional recesses centered upon respective vibration axes while a resonance bar is adhesively secured along the inner face of the front resonance place or oblique to the instrument axis and is formed with grooves or channels and portions which are not adhesively bonded to the front resonance plate. Surprisingly, this instrument provides a totally unique timbre and instrumental nuance to musical compositions played solely with violin techniques by instrumentalists trained only in the violin.

More particularly, each resonance plate is provided with a recess concentric with the longitudinal axis of the plate and with several recesses disposed about acoustic points situated on its surface while the rear resonance plate is curved in the longitudinal direction.

4. Objects of the Present Invention

It is therefore an object of the present invention to provide an improved musical system which avoids the above-described disadvantages.

Another object is the extension of the principles given in my above-cited copending applications to form an improved stringed-instrument musical system.

Yet another object is the provision of a series of easy-to-teach stringed instruments which may be employed by students in normal secondary schools and the like and in general by any group of children (or adults) with notation training for a single instrument and by a da braccio technique.

5. Summary of the Present Invention

I attain these objects with a series of bow-operable stringed instruments having substantially identical overall length, effective string length, and fingering, but different tuning, color, and nuance. Thus a broad-range shaded musical ensemble—quartet, quintet, orchestra— can be formed of instruments which are played in identical fashion. One teacher can teach all of the various instruments since they are all played da braccio and have identical fingering, and similarly one student can switch from one instrument to the other with hardly any difficulty.

For the sake of clarity this new series of instruments is called the family of VIODES and comprises five different subgroups whose names, although proprietary, are given here for convenience of description:

the VIODINA which corresponds roughly to the soprano part of the classical first violin;

the VIODENA which corresponds roughly to the alto part of the classical second violin;

the VIODA that takes over the tenor role of the classical viola;

the VIOBASA corresponding to the baritone voice usually taken by the cello; and the VIOGRAVA corresponding to the bass voice, which is usually the part of the classical contrabass.

Each subgroup comprises four instruments with different tone nuances or musical coloration, so that each subgroup has instruments A–D. All of the A instruments can be combined for a compatible string quintet, or the VIOGRAVA voice can be dropped for a quartet.

The B, C, or D series can be similarly combined. All twenty instruments when used together create a compatible string orchestra.

Each instrument is provided with front and rear sounding boards which are formed with at least two pairs of lateral resonance nodes (in the form of centrally symmetrical depression or concavities whose centers lie inwardly from the periphery of the sound board), each pair symmetrically flanking the instrument's longitudinal axis. The lateral resonance nodes are axially spaced apart and each located roughly in the four quadrants of the violin-type body. Each node is thus a depression which merges with the other nodes to give the sounding plate a sculptured or contoured appearance.

In addition the sounding plates are formed with a pair of central resonance nodes centered on the longitudinal axis and merging with the other nodes. These central nodes are axially spaced and flank a resonance land, or thickened part of the sounding board, which lies at the very center of each board.

Each instrument is provided with four strings tuned, violin-fashion, a fifth apart. Thus the VIODINA and VIODENA are tuned G, D, A, and E with the G lying a fifth below middle C. The VIODA is tuned a fifth lower than this, C, G, D, and A; the VIOBASA is tuned a full octave lower than the VIODINA and VIODENA; and the VIOGRAVA is tuned a twelfth lower than the VIODINA and VIODENA and an octave lower than the VIODE. The same fingering on different instruments will thereby produce harmonically compatible notes. For notation a treble or g-clef alone is used, plus a sharp for the VIODA and VIOGRAVA so that the VIODA, VIOBASA, and VIOGRAVA are transposing instruments.

It should be clear that such an arrangement allows virtually any musician trained to play any of the instruments to play any other of the instruments in the series; the only difference is in body size and neck width. Thus any four musicians can form a string quartet, with any one instrumentalist being able to take any part or voice. Since the music is not scored on separate g-, c-, and f-clefs all of the musicians can use a similar g-clef score.

Thus any school, for instance, with an average music program can develop at least a string quartet or quintet, and even a string orchestra. The same training can be given to all of the students to produce a full-color ensemble. At the same time no one part is of such pivotal importance so that if, for example, a few VIODENISTS are missing a VIOGRAVIST or two and a VIODIST can be switched over, at no detriment to the overall group. The experience of playing in a full-fledged orchestra will be exhilarating and extremely valuable for the students making, of course, general musical education a far easier task than it is at present.

6. Description of the Drawing

The above and other objects, features, and advantages will become apparent from the following, reference being made to the drawing in which:

FIGS. 4, 5, 6, and 7 are sections taken along line IV— IV, V— V, VI— VI and VIII— VII respectively of FIG. 3.

7. Specific Description

Figure 1:
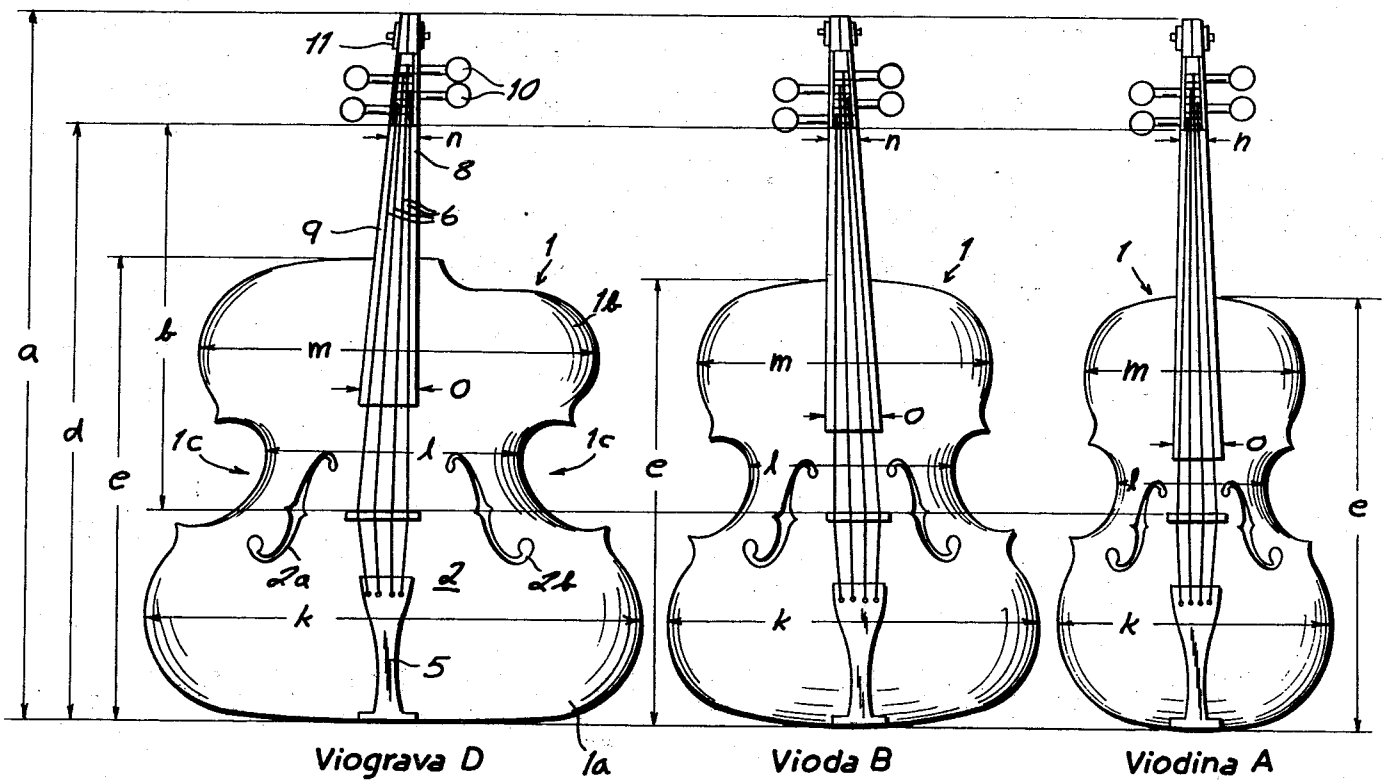
FIG. 1 is a front elevational view of three instruments from the musical system according to the present invention, namely the VIODINA A, the VIODA B, and the VIOGRAVA D.
Figure 2:
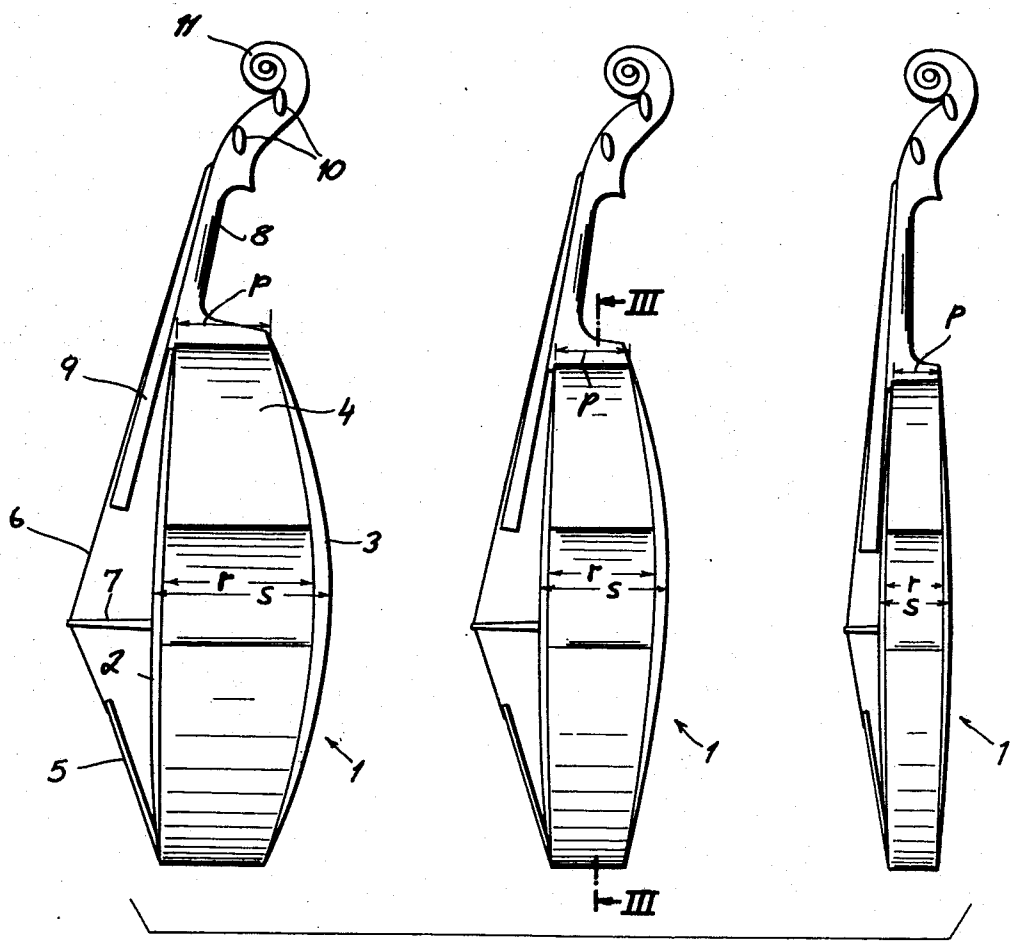
FIG. 2 is a side elevational view of the instruments of FIG. 1.
Figure 3:
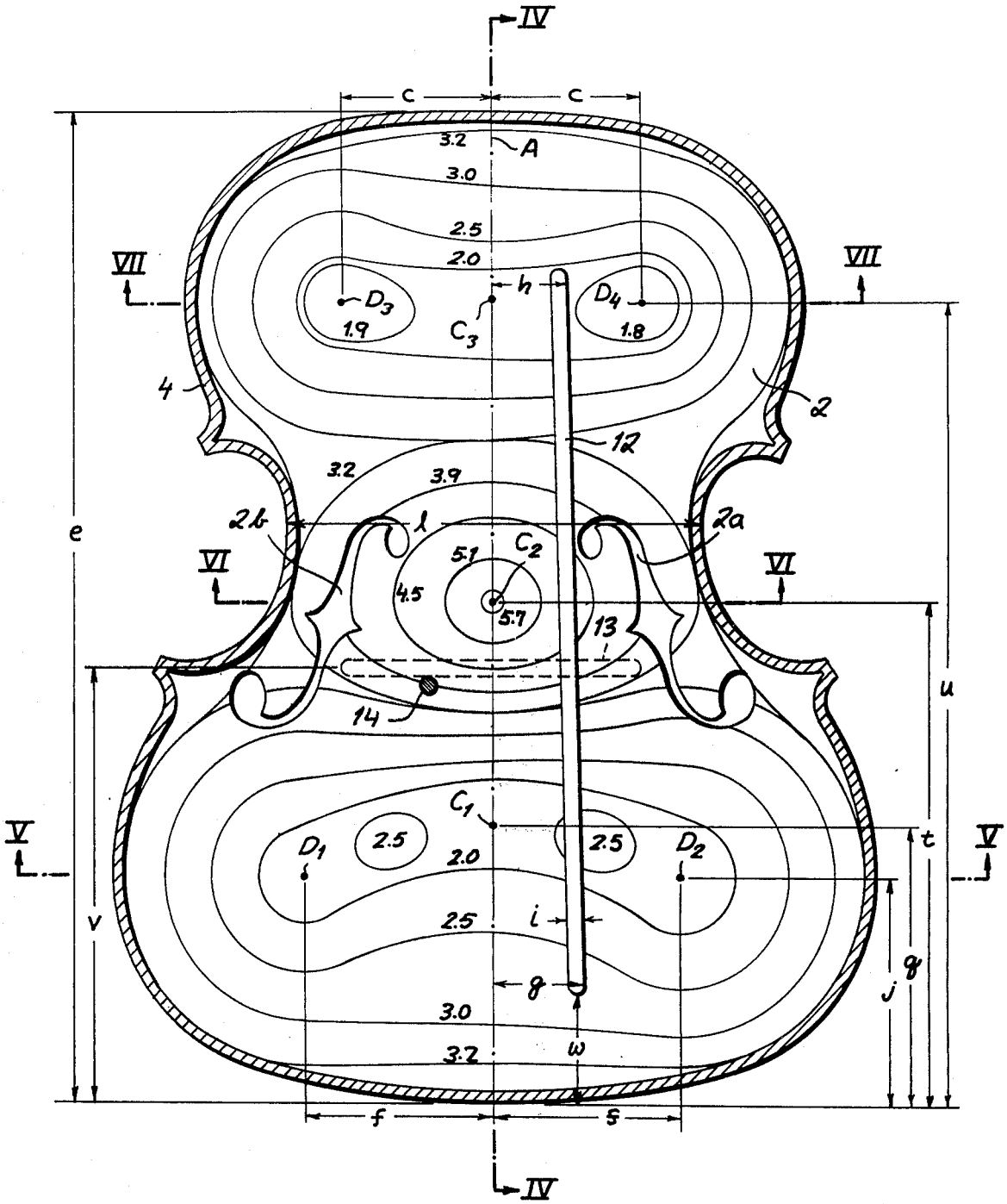
FIG. 3 is a section taken along line III— III of FIG. 2 showing the VIODA B in enlarged scale.

As shown in the FIGS. 1 and 2 each instrument comprises a resonance case 1 having a large lobe 1*a* and a small lobe 1*b* defined by cutouts 1*c* and formed by a front sounding board 2 provided with two f-shaped sound holes 2*a* and 2*b*, a rear sounding board 3, and a frame 4 glued between the two boards. A stringholder 5 is attached to the frame 4 and carries four strings 6 stretched over a bridge 7. A neck 8 provided with a fingerboard 9 extending over the sounding board 2 is fixed to the case 1 and carries at the head of the instrument a scroll 11 in which are fixed four pegs 10 for anchoring and tuning the strings 6.

It should be apparent from the drawing that the three instruments shown — the VIODINA A, the VIODA B, and the VIOGRAVA D— have certain dimensions in common and certain other dimensions that vary from one to the other. These three instruments are representative of the entire VIODE series, with the VIODINA A being the smallest instrument, the VIOGRAVA D being the largest instrument, and the VIODE B being substantially the middle-sized instrument. The other seventeen instruments have variable dimensions that are stepped between the dimensions given on the chart below:

| DIMENSION | VIODINA A | VIODE B | VIOGRAVA D |
|---|---|---|---|
| a-overall length | 600mm | 600mm | 600mm |
| b-effective length of strings 6 (distance | 330mm | 330mm | 330mm |

-continued

| DIMENSION | VIODINA A | VIODE B | VIOGRAVA D |
|---|---|---|---|
| between bridge 7 and scroll 11) | | | |
| d-effective length of instrument | 500mm | 500mm | 500mm |
| e-length of resonance case 1 | 360mm | 370mm | 380mm |
| k-width of large lobe 1a | 220mm | 292mm | 400mm |
| l-width of case 1 at cutouts 1c | 120mm | 156mm | 200mm |
| m-width of small lobe 1b | 180mm | 234mm | 320mm |
| n-width of fingerboard 9 adjacent scroll 11 | 22mm | 24mm | 26mm |
| o-width of fingerboard 9 at end towards bridge 7 | 42mm | 44mm | 46mm |
| p-thickness of frame 4 at ends of case 1 | 31mm | 40mm | 50mm |
| r-thickness of frame 4 at cutouts 1c | 36mm | 63mm | 100mm |
| s-maximum instrument thickness | 72mm | 103mm | 145mm |
| overall volume of instrument case 1 | 2650–2700mm | 5700–5800mm | 11,500–12.00mm |
| overall instrument weight | 440–450g | 660–670g | 880–900g |
| fundamental resonant frequency | 140Hz | 98Hz | 76Hz |

The above figures should make it obvious that although some instruments of the series will be somewhat bulkier than others, they all have certain identical dimensions— overall length, effective string length, etc.— which will make playing them substantially the same from one instrument to the other. Although the VIOGRAVA D is the largest instrument, it is only 450 grams heavier than the smallest instrument in the series. Its fingerboard width is only on the average 4 millimeters greater than that of the VIODINA A, which difference has been found to be easily adjusted to by the users. Of course the strings applied to the various instruments will vary according to principles well known in the art.

In order to figure out the dimensions of another instrument in the series the above-given numbers are used and the desired figures are extrapolated. For instance to figure out the dimension *e*— length of resonance case 1— of the VIODENA A, which is the fifth instrument in the series of the twenty instruments, the figures of 360mm for the first instrument and 370mm for the tenth are interpolated and a figure of about 364.4mm is arrived at, which would be the resonance-case length for the VIODENA A. Other dimensions would be calculated in a similar fashion.

It should be noted that the bodies of the VIOGRAVA C and the VIOGRAVA D are cut out at 1*c* to accommodate the left hand of the user. This cutout 1*c* has little effect on the overall tonal qualities of the da braccia instrument and still allows the artist to stop the strings 6 well along on the neck.

Two crenellated resonance bars 12 and 13 are glued to the inner face of the front sounding board 2 and are provided at their contact surfaces with respective notches 12*a* and 13*a* where no gluing takes place. The resonance bar 12 is slightly oblique to the longitudinal symmetry axis A of the board and the resonance bar 13 is perpendicular thereto and parallel to the transverse symmetry axis. A resonance pin 14 is pressed between the sounding boards 2 and 3. The resonance bar 12 has a center 12*b* from which wings 12*c* extend outwardly, the convex face 12*d* of the bar being formed with the grooves 12*a*. Along the lands 12*e* between these grooves the bar 12 is adhesively secured to the inner surface of the front resonance plate 2. The bar 13 is essentially identically formed except that its edge 13*b* is straight. This bar 13 fits fully between the sound holes 2*a* and 2*b* and lies parallel to and directly under the bridge 7.

FIGS. 3–7 show the inner face of resonance plate 2 which is substantially identical to resonance plate 3 although flatter. This plate 2 is formed at its wide lobe with a pair of resonance nodes $D_1$ and $D_2$ flanking the axis A and its narrow lobe with another pair of recessed resonance lobes $D_3$ and $D_4$ which similarly flank the axis A. In addition spaced along the axis are three more resonance centers $C_{1-3}$, comprising two outer resonance nodes $C_1$ and $C_3$ and a central resonance land $C_2$. The resonance plate 2 is formed of a board approximately 3.3 millimeters thick at its edge. In addition it has the following thickness at the center of each resonant point:

$C_1 = 2mm$
$C_2 = 5.7mm$
$C_3 = 2mm$
$D_1 = 2mm$
$D_2 = 1.9mm$
$D_3 = 1.9mm$
$D_4 = 1.8mm$

The centers $C_{1-3}$ and $D_{1-4}$ of the various resonant zones are spaced from the axis A and from the large end of the case 1 by distances described and given below:

| | |
|---|---|
| c = distance of nodes $D_3$ and $D_4$ from axis A | 57mm |
| f = distance of nodes $D_1$ and $D_2$ from axis A | 71 mm |
| j = distance from case end to nodes $D_1$ and $D_2$ | 85mm |
| q = distance from case end to node $C_1$ | 105mm |
| t = distance from case end to node $C_2$ | 187mm |
| u = distance from case end to nodes $C_3$, $D_3$ and $D_4$ | 300 mm |

In addition each resonance bar 12 is 268 millimeters long and lies oblique to the axis so that its end nearer the neck 8 of the instrument is closer to this axis than its other end. This bar 12 is spaced at a distance *g* of 29mm from the axis A at one end and at a distance *h* of 23mm at the other end, with the difference between these distances being equal to the thickness *i* (6mm) of the bar 12. The end of the bar spaced further from the axis A is situated at a distance *w* of 40mm from the widest end of the VIODA B.

The resonance bar 13 lies perpendicular to the axis A and at a distance *v* of 160mm from the wide end of the case 1. This bar 13 is directly beneath the bridge 7 of the instrument. The resonance pin is located adjacent the bar 13 and slightly to one side of the axis A, its exact position being determined after the instrument is assembled for best color and timbre.

Of course the dimensions given above are for the VIODA B. The corresponding dimensions of the other instruments in the series can be simply extrapolated from these dimensions.

Each resonance zone blends into the neighboring zones so that the resonance plate will sound for virtually every note playable by the instrument. The tone that can be obtained from thus contoured sounding boards is extremely rich.

In order to hold the larger instruments, mainly the VIOBASA and VIOGRAVA, it has been found advantageous to provide an elastic sustaining band which is connected between the instrument neck and a special music stand. Nonetheless even the largest instrument can be held without undue effort solely by a normal adult, the described appliance only being necessary with young or small musicians.

The musical system according to the present invention combines the advantages of extreme simplicity and ease of teaching with the possibility of producing a rich and varied orchestral tone. The twenty different instruments being played in exactly the same manner produce an extremely broad and colored tone.

I claim:

1. A musical-instrument system comprising at least four, stringed, violin-type, bow-operated instruments in ensemble and played da braccio all with identical overall length, notation clefs and substantially identical effective string length, said instruments having a common fingering and graduated body width with resonance shades corresponding at least to soprano, alto, tenor, and bass voices.

2. The system defined in claim 1 wherein each instrument is substantially as long as a violin.

3. The system defined in claim 2 wherein the instruments each have four strings tuned one fifth apart.

4. The system defined in claim 3 wherein the instruments include at least four groups comprising an upper group, a group tuned one fifth lower than the upper group, a group tuned one octave lower than the upper group, and a group tuned one twelfth lower than the upper group.

5. The system defined in claim 3 wherein each instrument comprises:

a hollow body having an axis and formed of a rear sounding board, a front sounding board, and a frame separating said sounding boards; and a neck extending axially from said body along said strings, at least one of said sounding boards being formed with at least two pairs of lateral recessed resonance zones, the zones of each pair symmetrically flanking said axis and being formed as center-symmetrical concavities with their centers equispaced from the axis, one of said pairs of recessed zones being longitudinally spaced from the other pair along the longitudinal axis of the instrument.

* * * * *